US010184207B2

(12) United States Patent
Kim et al.

(10) Patent No.: US 10,184,207 B2
(45) Date of Patent: Jan. 22, 2019

(54) LAUNDRY TREATMENT APPARATUS

(71) Applicant: LG ELECTRONICS INC., Seoul (KR)

(72) Inventors: Doohyun Kim, Seoul (KR); Seungwoo Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 343 days.

(21) Appl. No.: 15/223,259

(22) Filed: Jul. 29, 2016

(65) Prior Publication Data

US 2017/0030007 A1 Feb. 2, 2017

(30) Foreign Application Priority Data

Jul. 30, 2015 (KR) ..... 10-2015-0108231

(51) Int. Cl.
*D06F 58/24* (2006.01)
*D06F 58/20* (2006.01)
(Continued)

(52) U.S. Cl.
CPC ..... *D06F 58/24* (2013.01); *D06F 25/00* (2013.01); *D06F 39/005* (2013.01);
(Continued)

(58) Field of Classification Search
CPC ..... D06F 58/24; D06F 58/02; D06F 25/00; D06F 39/005; D06F 39/028; D06F 39/085; D06F 39/088; D06F 58/20; D06F 39/02
(Continued)

(56) References Cited

U.S. PATENT DOCUMENTS 2,742,708 A * 4/1956 McCormick ..... D06F 58/02 34/60
2,752,694 A * 7/1956 McCormick ..... D06F 58/02 34/60
(Continued)

FOREIGN PATENT DOCUMENTS

CN 101387059 A 3/2009
CN 101796244 A 8/2010
(Continued)

OTHER PUBLICATIONS

Extended European Search Report issued in European Application No. 16181649.1 dated Oct. 12, 2016, 9 pages.

*Primary Examiner* — Stephen M Gravini
(74) *Attorney, Agent, or Firm* — Fish & Richardson P.C.

(57) ABSTRACT

A laundry treatment apparatus includes a cabinet. The laundry treatment apparatus further includes an outer tub. The laundry treatment apparatus further includes a circulation duct that is configured to guide air circulating through the outer tub. The laundry treatment apparatus further includes an exhaust duct that is configured to guide air exhausted from the outer tub. The laundry treatment apparatus further includes an air suction duct that is configured to guide air from outside the laundry treatment apparatus into the outer tub. The laundry treatment apparatus further includes a fan that is configured to circulate air through the outer tub. The laundry treatment apparatus further includes a heater that is located in the circulation duct and that is configured to heat air entering the outer tub. The laundry treatment apparatus further includes a plurality of heat-exchanging tubes. The laundry treatment apparatus further includes a condensed water pipe.

20 Claims, 8 Drawing Sheets

(51) Int. Cl.

| | |
|---|---|
| ***D06F 25/00*** | (2006.01) |
| ***D06F 39/00*** | (2006.01) |
| ***D06F 39/08*** | (2006.01) |
| *D06F 39/02* | (2006.01) |
| *D06F 58/02* | (2006.01) |

(52) U.S. Cl.
CPC ..... *D06F 39/028* (2013.01); *D06F 39/085* (2013.01); *D06F 39/088* (2013.01); *D06F 58/20* (2013.01); *D06F 39/02* (2013.01); *D06F 58/02* (2013.01)

(58) Field of Classification Search
USPC ..... 34/86
See application file for complete search history.

(56) References Cited

U.S. PATENT DOCUMENTS

| | | | | | |
|---|---|---|---|---|---|
| 2,785,557 | A * | 3/1957 | Stilwell, Jr. | D06F 25/00 | 137/218 |
| 3,805,404 | A * | 4/1974 | Gould | D06F 58/04 | 34/596 |
| 4,603,489 | A * | 8/1986 | Goldberg | D06F 58/02 | 34/605 |
| 6,151,795 | A * | 11/2000 | Hoffman | D06F 58/12 | 34/605 |
| 6,530,245 | B1 * | 3/2003 | Kawabata | D06F 25/00 | 68/140 |
| 9,163,352 | B2 * | 10/2015 | Han | D06F 58/26 | |
| 9,279,211 | B2 * | 3/2016 | Kim | D06F 58/26 | |
| 9,290,885 | B2 * | 3/2016 | Kim | D06F 58/26 | |
| 2012/0159800 | A1 * | 6/2012 | Del Pos | D06F 58/04 | 34/74 |
| 2014/0165417 | A1 | 6/2014 | Ahn et al. | | |
| 2015/0059413 | A1 | 3/2015 | Yoo et al. | | |
| 2016/0258107 | A1 * | 9/2016 | Hake | D06F 15/02 | |
| 2016/0298280 | A1 * | 10/2016 | Schaben | D06F 58/20 | |
| 2016/0362830 | A1 * | 12/2016 | Rice | D06F 58/26 | |
| 2017/0010047 | A1 * | 1/2017 | Lv | D06F 58/24 | |
| 2017/0268159 | A1 * | 9/2017 | Brown | D06F 58/02 | |
| 2018/0155863 | A1 * | 6/2018 | Jo | D06F 25/00 | |
| 2018/0187367 | A1 * | 7/2018 | Bae | D06F 58/20 | |

FOREIGN PATENT DOCUMENTS

| | | | | |
|---|---|---|---|---|
| CN | 101988260 | A | 3/2011 | |
| CN | 102477687 | A | 5/2012 | |
| CN | 103348053 | A | 10/2013 | |
| CN | 204023223 | A | 12/2014 | |
| CN | 204404859 | | 6/2015 | |
| DE | 3738031 | A | 5/1989 | |
| EP | 3124681 | A1 * | 2/2017 | D06F 58/20 |
| JP | 2013-085800 | | 5/2013 | |
| KR | 10-0638969 | | 10/2006 | |
| KR | 10-0826537 | | 5/2008 | |
| KR | 10-2008-0082496 | | 9/2008 | |
| KR | 10-2008-0107788 | | 12/2008 | |
| KR | 10-2015-0026548 | | 3/2015 | |
| WO | 2013/182405 | | 12/2013 | |
| WO | WO 2014115999 | A1 * | 7/2014 | D06F 58/26 |
| WO | WO 2014116001 | A1 * | 7/2014 | D06F 58/26 |
| WO | WO 2014116002 | A1 * | 7/2014 | D06F 58/26 |

* cited by examiner

LAUNDRY TREATMENT APPARATUS

CROSS-REFERENCE TO RELATED APPLICATION

This application claims the benefit of Korean Patent Application No. 10-2015-0108231 filed on Jul. 30, 2015, the disclosure of which is incorporated herein by reference.

FIELD

The present disclosure relates to a laundry treatment apparatus.

BACKGROUND

Laundry treatment apparatuses, which can dry laundry using heated air (hot wind) supplied to the laundry, are classified into a laundry treatment apparatus equipped with an exhaust type drying system and a laundry treatment apparatus equipped with a circulation type drying system in accordance with how heated air supplied to laundry is treated after exchanging heat with the laundry.

SUMMARY

According to an innovative aspect of the subject matter described in this application, a laundry treatment apparatus includes a cabinet; an outer tub that is located in the cabinet; a circulation duct that is configured to guide air circulating through the outer tub; an exhaust duct that is configured to guide air exhausted from the outer tub; an air suction duct that is configured to guide air from outside the laundry treatment apparatus into the outer tub; a fan that is configured to circulate air through the outer tub; a heater that is located in the circulation duct and that is configured to heat air entering the outer tub; a plurality of heat-exchanging tubes that are located at the exhaust duct and that is configured to allow air to pass through gaps that are defined by the plurality of heat-exchanging tubs that are spaced apart from each other a predetermined distance; and a condensed water pipe that is configured to guide water that condenses on the plurality of heat-exchanging tubes.

This and other implementations may include one or more of the following optional features. The air suction duct is configured to guide air into the circulation duct. The heater is located between (i) an intersection of the air suction duct and the circulation duct and (ii) the outer tub. The laundry treatment apparatus further includes a cold air duct that is configured to guide air from outside the laundry treatment apparatus through the gaps in the plurality of heat-exchanging tubes; and a cooling fan to move air in the cold air duct. The cold air duct is configured to guide air into the circulation duct and into a downstream side of the gaps of the plurality of heat-exchanging tubes. The heater is located between (i) an intersection of the cold air duct and the circulation duct and (ii) the outer tub. The laundry treatment apparatus further includes a cooling water pipe that is configured to guide water through the gaps in the plurality of heat-exchanging tubes.

The condensed water pipe is connected to the cooling water pipe and is configured to guide condensed water to a downstream side of the gaps in the plurality of heat-exchanging tubes. The condensed water pipe is connected to the cooling water pipe and is configured to guide condensed water to an upstream side of the gaps in the plurality of heat-exchanging tubes. The laundry treatment apparatus further includes a detergent supplier that is configured to supply detergent and water to the outer tub. The cooling water pipe is configured to guide water to the detergent supplier from a downstream side of the gaps in the plurality of heat-exchanging tubes. The laundry treatment apparatus further includes a filter that is configured to filter foreign matter from air; and a filter washing nozzle that is configured remove filtered foreign matter from the filter by providing water to the filter. The cooling water pipe is configured to guide water from a downstream side of the gaps in the plurality of heat-exchanging tubes to the filter washing nozzle.

The laundry treatment apparatus further includes a detergent supplier that is configured to supply detergent and water to the outer tub. The condensed water pipe is configured to guide condensed water to the detergent supplier. The laundry treatment apparatus further includes a filter that is configured to filter foreign matter from air; and a filter washing nozzle that is configured remove filtered foreign matter from the filter by providing water to the filter. The condensed water pipe is configured to guide condensed water to the filter washing nozzle. Upstream ends of the plurality of heat-exchanging tubes are coupled together and downstream ends of the plurality of heat-exchanging tubes are coupled together. The plurality of heat-exchanging tubes each define a center point and center points of six heat-exchanging tubes define corners of a regular hexagon.

A center point of a seventh heat-exchanging tube is located at a center of the regular hexagon. Each distance that separates adjacent heat-exchanging tubes of the six and seventh heat-exchanging tubes is a same predetermined distance. Downstream ends of the plurality of heat-exchanging tubes are sloped towards the exhaust duct. The condensed water pipe is connected to the downstream ends of the plurality of heat-exchanging tubes. Upstream ends of the plurality of heat-exchanging tubes are sloped towards the exhaust duct. The condensed water pipe is connected to the upstream ends of the plurality of heat-exchanging tubes. The downstream ends of the plurality of heat-exchanging tubes are sloped towards the exhaust duct 90 degrees. The upstream ends of the plurality of heat-exchanging tubes are sloped towards the exhaust duct 90 degrees.

It is an object of the subject matter described in this application to enhance drying efficiency while reducing consumption of energy and cooling water required to dry laundry.

It is another object of the subject matter described in this application to avoid generation of dew around a laundry treatment apparatus due to air exhausted during drying of laundry.

It is another object of the subject matter described in this application to achieve automatic separation and discharge of condensed water generated in a condenser.

It is another object of the subject matter described in this application to achieve re-use of condensed water generated in the condenser in an apparatus equipped with the condenser.

It is another object of the subject matter described in this application to achieve re-use of cold air or cooling water having exchanged heat with air exhausted from the condenser in an apparatus equipped with the condenser.

It is another object of the subject matter described in this application to achieve convenient application of a condenser, which condenses moisture contained in exhaust air, to various products through a modular design of the condenser.

It is another object of the subject matter described in this application to provide a condenser adjustable in standard and volume.

It is still another object of the subject matter described in this application to provide a condenser, which can be driven with relatively reduced energy, as compared to a condenser using an evaporator or a thermoelectric device.

DETAILED DESCRIPTION

Figure 1:
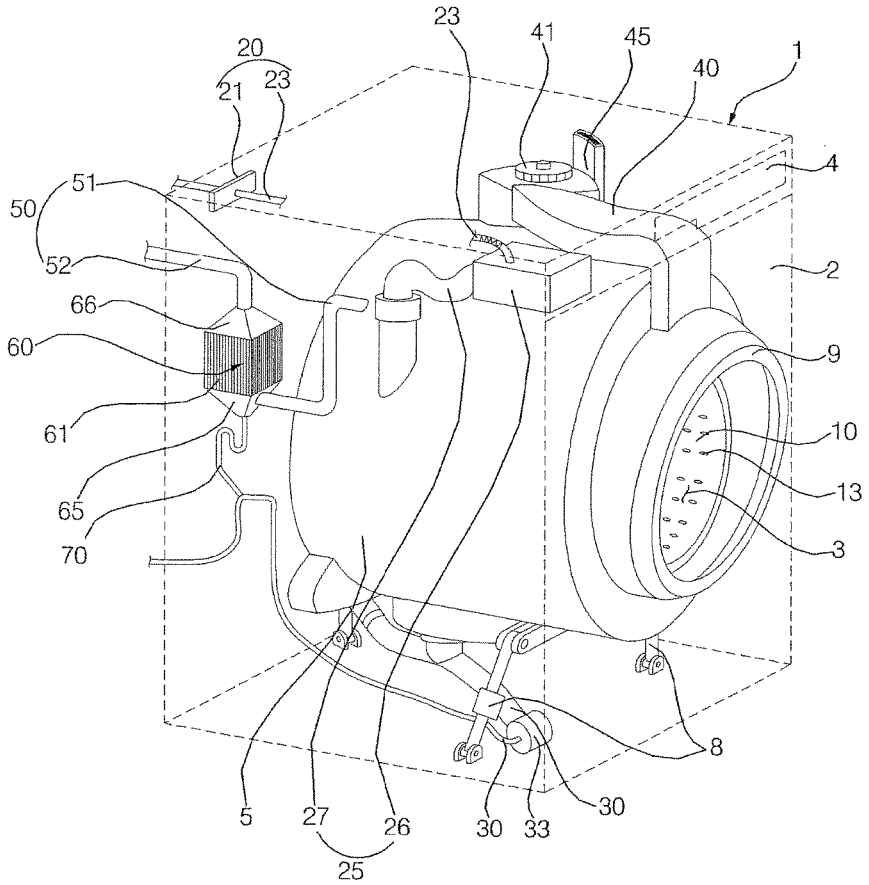
FIG. 1 is a perspective view of an inner configuration of an example cabinet included in a washing machine.

A laundry treatment apparatus may be a washing machine, a drying machine, or the like. The following description will be given in conjunction with implementations associated with a front loading type laundry machine equipped with a drying system. In some implementations, the drying system means a hybrid drying system for circulating a portion of air present in an outer tub while exhausting some other portion of the air. FIG. 1 illustrates an example cabinet 1 included in a washing machine.

The washing machine includes the cabinet 1, which defines an appearance of the washing machine. The washing machine further includes an outer tub 5 disposed within the cabinet 1, to store wash water. The washing machine also includes an inner tub 10 rotatably disposed within the outer tub 5, to receive laundry and wash water. Air containing moisture generated from laundry present in the inner tub 10 is present in the outer tub 5.

In addition, the washing machine includes a water supplier 20 for supplying water from an external water supply source to the interior of the outer tub 5, and a detergent supplier 25 for supplying a detergent to the outer tub 5. The washing machine further includes a drainage duct 30 for guiding wash water present in the outer tub 5 to be drained to the outside of the cabinet 1, and a drainage pump 33 provided at the drainage duct 30, to drain wash water.

In addition, the washing machine includes a circulation duct 40 for guiding a portion of air present in the outer tub 5 to be re-supplied to the outer tub 5 after being discharged from the outer tub 5. The washing machine also includes a fan 41 disposed at the circulation duct 40, to circulate air present in the outer tub 5 along the circulation duct 40, and a heater 43 provided at the circulation duct 40, to heat air introduced into the outer tub 5.

The washing machine further includes an air suction duct 45 for guiding air present outside the outer tub 5 or cabinet 1 to the interior of the outer tub 5. In addition, the washing machine includes an exhaust duct 50 for guiding a portion of air present in the outer tub 5 to be exhausted, except for a remaining portion of the air, namely, air to be introduced into the circulation duct 40. The washing machine may further include a filter 47 provided at the air suction duct 45 or circulation duct 40, to filter air introduced from the outside.

The cabinet 1 includes a front panel 2 defining a front wall of the washing machine. The front panel 2 is provided with a laundry port 3 for loading laundry into the inner tub 10 or unloading the loaded laundry from the inner tub 10. The laundry port 3 is opened or closed by a door 14 rotatably coupled to the cabinet 1.

A control panel 4 as a user interface is also provided at the front panel 2. The control panel 4 is a means for enabling the user to exchange information with a controller of the washing machine.

The control panel 4 is also provided with a power input unit for allowing the user to input a power supply command to the washing machine, and an input unit for allowing the user to select a laundry treatment method that can be implemented by the washing machine. The laundry treatment method includes a method for performing a control operation to supply water or air to laundry. The control panel 4 may also be provided with a display for displaying information as to the laundry treatment method selected by the user or an operation procedure of the washing machine.

The outer tub 5 has a cylindrical shape, and is fixed to the cabinet 1 within the cabinet 1 by outer tub supporters 8. An outer tub port connected to the laundry port 3 is provided at a front wall of the outer tub 5.

A gasket 9 is provided between the outer tub port and the laundry port 3. The gasket 9 prevents vibration generated at the outer tub 5 from being transferred to the cabinet 1. The gasket 9 also prevents leakage of wash water stored in the outer tub 5. The gasket 9 may be made of an elastic material such as rubber.

The inner tub 10 is disposed within the outer tub 5 while being rotatable by a driver provided at a rear wall of the outer tub 5. The inner tub 10 is provided with an inner tub port connected to the outer tub port. Through holes 13 are formed through a circumferential wall of the inner tub 10.

The water supplier 20 includes a water supply line 23 for guiding water from a water supply source disposed outside the cabinet 1 to the detergent supplier 25, and a water supply valve 21 for opening or closing the water supply line 23. The detergent supplier 25 includes a detergent storage 26 for storing a detergent, and a detergent supply pipe 27 for guiding water containing the detergent from the detergent storage 26 to the interior of the outer tub 5. The detergent storage 26 may be provided to be ejectable from the front panel 2.

The drainage duct 30 extends upwards to a position higher than the level of wash water in the outer tub 5 and, as such, a water trap may be formed by wash water being drained. The drainage pump 33 is disposed at a position lower than the level of wash water in the outer tub 5. The drainage pump 33 may be disposed at a lowest point of the drainage duct 30.

The circulation duct 40 guides a portion of air present in the outer tub 5 to be re-supplied to the outer tub 5 after being discharged from the outer tub 5. The circulation duct 40 may be provided at an upper portion of a circumferential wall of the outer tub 5. Circulation duct connectors to be connected to the outer tub 5 are formed at upstream and downstream ends of the circulation duct 40, respectively. In some implementations, the circulation duct connector at the side of the downstream end of the circulation duct 40 may be formed at a top portion of the gasket 9. That is, a hole is formed through the gasket 9 and, as such, the circulation duct 40 is connected to the hole.

The air suction duct 45 may be directly connected to the outer tub 5, or may be connected to a flow path of the circulation duct 40. In some implementations, the air suction duct 45 guides outdoor air to be introduced into the circulation duct 40. The heater 43 is disposed downstream of a point where air present in the air suction duct 45 is introduced into the circulation duct 40. In addition, the circulation fan 41 is disposed downstream of the point where air present in the air suction duct 45 is introduced into the circulation duct 40. Accordingly, it may be possible to heat both circulated air and suctioned air, using one heater 43, and to simultaneously achieve air circulation and air suction, using one circulation fan 41.

When an inlet of the air suction duct 45 is disposed inside the cabinet 1, air present in a space between the cabinet 1 and the outer tub 5 is introduced into the outer tub 5. In some implementations, when the inlet of the air suction duct 45 is disposed outside the cabinet 1, air present outside the cabinet 1 is introduced into the outer tub 5. In this disclosure, "outdoor air" includes both air present outside the cabinet 1 and air present between the cabinet 1 and the outer tub 5.

In some implementations, the filter 47 is provided at the circulation duct 40, to filter out foreign matter contained in air flowing through the circulation duct 40. The filter 47 is disposed downstream of a connection point between the circulation duct 40 and the air suction duct 45. The washing machine includes a filter washing nozzle 48 for injecting water, to remove filtered-out foreign matter from the filter 47.

The washing machine also includes a condensing unit 60 disposed at the exhaust duct 50 such that exhaust air passes through the condensing unit 60, and a condensed water pipe 70 for guiding condensed water generated within the condensing unit 60. The washing machine may also include a cold air duct 80 for guiding outdoor air to exchange heat with exhaust air in the condensing unit 60. In addition, the washing machine may include a cooling water pipe 90 for guiding water to exchange heat with exhaust air in the condensing unit 60.

The condensing unit 60 includes a plurality of heat-exchanging capillary tubes 61 disposed at the exhaust duct 50 such that exhaust air passes around the heat-exchanging tubes 61. The heat-exchanging tubes 61 are spaced apart from each other by a predetermined distance to form a gap 62. The heat-exchanging tubes 61 have a structure formed by a bundle of circular fine tubes arranged in parallel. Exhaust air and condensed water pass through the heat-exchanging tubes 61. Outdoor air (cold air) or water (cooling water) as a heat-exchanging medium passes through the spacing 62 defined between the adjacent heat-exchanging tubes 61.

The exhaust duct 50 has a first section 51 for guiding air present in the outer tub 5 to be introduced into the heat-exchanging tubes 61. The first section 51 of the exhaust duct 50 may guide a portion of the air present in the outer tub 5 to be introduced into the heat-exchanging tubes 61, except for the remaining portion of the air, namely, air to be circulated. In some implementations, the first section 51 of the exhaust duct 50 is directly connected, at one end thereof, to the outer tub 5. In addition, the first section 51 of the exhaust duct 50 may be connected to any position of the outer tub 5, but is connected to at the upper portion of the circumferential wall of the outer tub 5.

The exhaust duct 50 also has a second section 52 for guiding air discharged from the heat-exchanging tubes 61 to be discharged to the outside. In some implementations, the second section 52 of the exhaust duct 50 discharges air to the outside of the cabinet 1. In some implementations, the second section 52 of the exhaust duct 50 discharges air into a space between the outer tub 5 and the cabinet 1. In this disclosure, "discharge of air" is associated with both of the above-described implementations.

The condensing unit 60 includes a first connector 65 for connecting one end of each of the heat-exchanging tubes 61 to the first section 51 of the exhaust duct 50. The condensing unit 60 also includes a second connector 66 for connecting the other end of each of the heat-exchanging tubes 61 to the second section 52 of the exhaust duct 50. The first connector 65 guides air emerging from the first section 51 of the exhaust duct 50 to be introduced into the heat-exchanging tubes 61. The second connector 66 guides air emerging from the heat-exchanging tubes 61 to be introduced into the second section 52 of the exhaust duct 50.

The condensed water pipe 70 guides condensed water generated in the heat-exchanging tubes 61. The condensed water pipe 70 is connected, at one end thereof, to one of the first and second connectors 65 and 66. One end of the condensed water pipe 70 is connected to the connector connected to the side at which condensed water flows outwards in accordance with slope of the heat-exchanging tubes 61 (the first connector 65 or the second connector 66). The connector connected to the end of the condensed water pipe 70 may have a funnel structure in order to allow condensed water to be collected at the end of the condensed water pipe 70.

The position of the other end of the condensed water pipe 70 may be varied i. In some implementations, the other end of the condensed water pipe 70 may be connected to the drainage duct 30, for drainage of condensed water to the outside, as illustrated in FIG. 1. The condensed water pipe 70 may have a section where a water trap is formed. The water trap functions to prevent air flowing through the exhaust duct 50 from flowing through the condensed water pipe 70.

In some implementations, the condensing unit 60 may include a condensing case enclosing the entirety of the heat-exchanging tubes 61. In some implementations, the condensing case is connected to the cold air duct 80 or cooling water pipe 90, to guide air (cold air) or water (cooling water) to the gaps 62 of the heat-exchanging tubes 61. In some implementations, the condensing unit 60 may be implemented without including any condensing case, as illustrated in FIG. 1. In this case, of course, air or water may exchange heat with exhaust air while flowing through the gaps 62.

Figure 2:
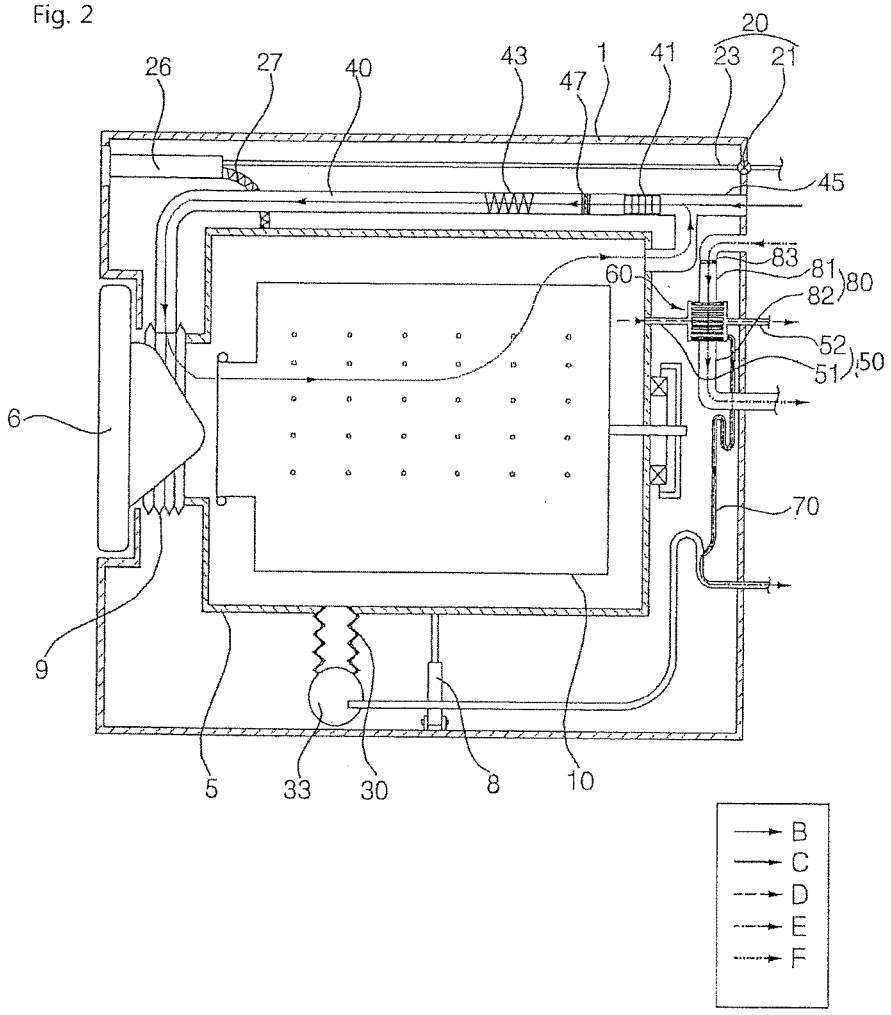
FIG. 2 is a conceptual sectional diagram of example ducts and pipes and flow directions of air and condensed water in a laundry treatment apparatus.
Figure 3:
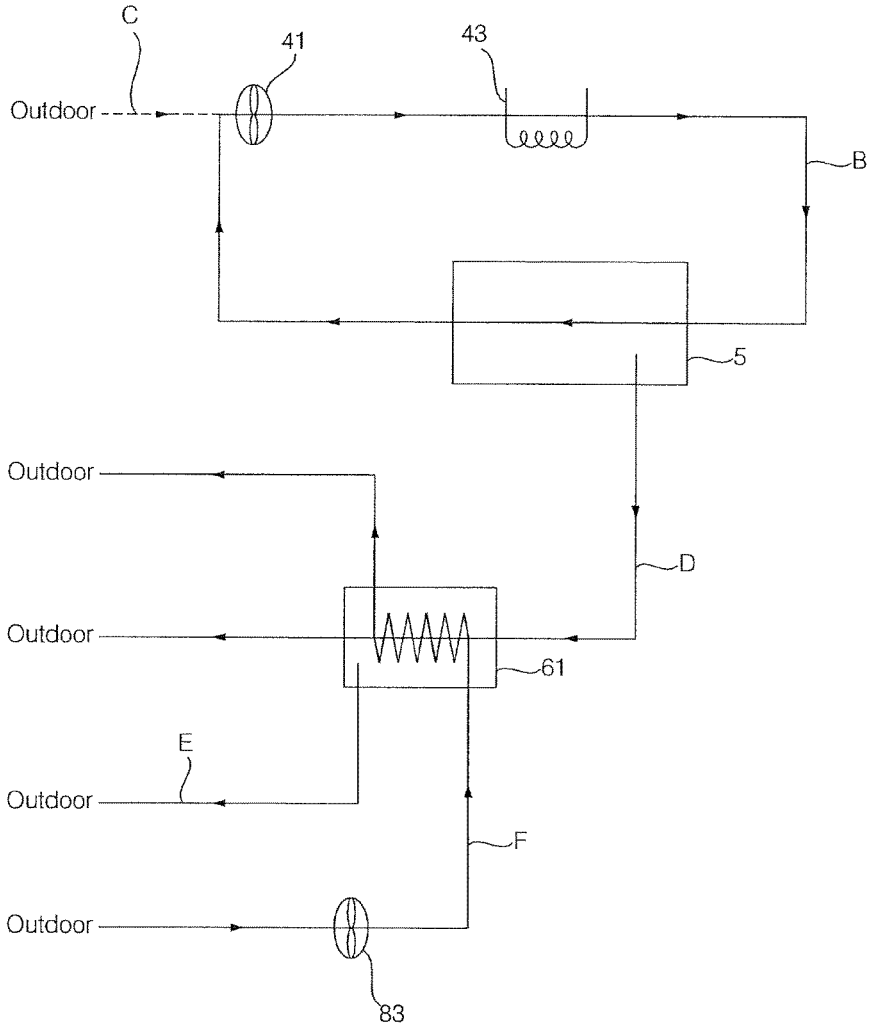
FIG. 3 is a conceptual diagram of example flows of air and water.

Hereinafter, flows of air and water according to an example implementation will be described. FIG. 2 illustrates example ducts and pipes and flow directions of air and condensed water in a laundry treatment apparatus. FIG. 3 illustrates example flows of air and water.

In FIG. 2, the direction of an arrow B is a circulation direction of air in the outer tub 5. During operation of the fan 41, air is moved from the interior of the outer tub 5 maintained in a positive pressure state to the circulation duct 40 maintained in a negative pressure state. A portion of air present in the outer tub 5 may be moved to the circulation duct 40. Air moved to the circulation duct 40 is heated while passing around the heater 43, and is then re-supplied to the interior of the outer tub 5.

The direction of an arrow C is an introduction direction of outdoor air. During operation of the fan 41, air is introduced from the outside of the outer tub 5 or cabinet 1 maintained in an atmospheric pressure state into the circulation duct 40 maintained in a negative pressure state. Air introduced into the circulation duct 40 is heated while passing around the heater 43, and is then supplied to the interior of the outer tub 5.

The direction of an arrow D is an exhaust direction of air. During operation of the fan 41, air is introduced from the interior of the outer tub 5 maintained in a positive pressure state to the plurality of heat-exchanging tubes 61 along the first section 51 of the exhaust duct 50. Air introduced into the heat-exchanging tubes 61 exchanges heat with a heat-exchanging medium (cold air or cooling water) flowing through the gaps 62 and, as such, generates condensed water. After generation of condensed water, the air is introduced into the second section 52 of the exhaust duct 50 and, as such, is exhausted to the outside of the outer tub 5 or cabinet 1.

The direction of an arrow E is a flow direction of condensed water. Condensed water generated in the heat-exchanging tubes 61 flows downwards along inner surfaces of the heat-exchanging tubes 61 and, as such, is collected at the first connector 65 or second connector 66. The collected condensed water is introduced into the condensed water pipe 70. The condensed water introduced into the condensed water pipe 70 is drained to the outside of the cabinet 1.

The direction of an arrow F is a flow direction of cold air. The cold air duct 80 may be implemented with a separate pipe or duct. In some implementations, the cold air duct 80 may be implemented with a space defined between the outer tub 5 and the cabinet 1. The washing machine includes a cooling fan 83 for moving air in the cold air duct 80. During operation of the cooling fan 83, air present outside the outer tub 5 or cabinet 1 is guided to the gaps 62 of the heat-exchanging tubes 61 along a first section 81 of the cold air duct 80. The air moving through the gaps 62 exchanges heat with air moving through the heat-exchanging tubes 61. Air having exchanged heat while moving through the gaps 62 is exhausted outwards through a second section 82 of the cold air duct 80.

Figure 4:
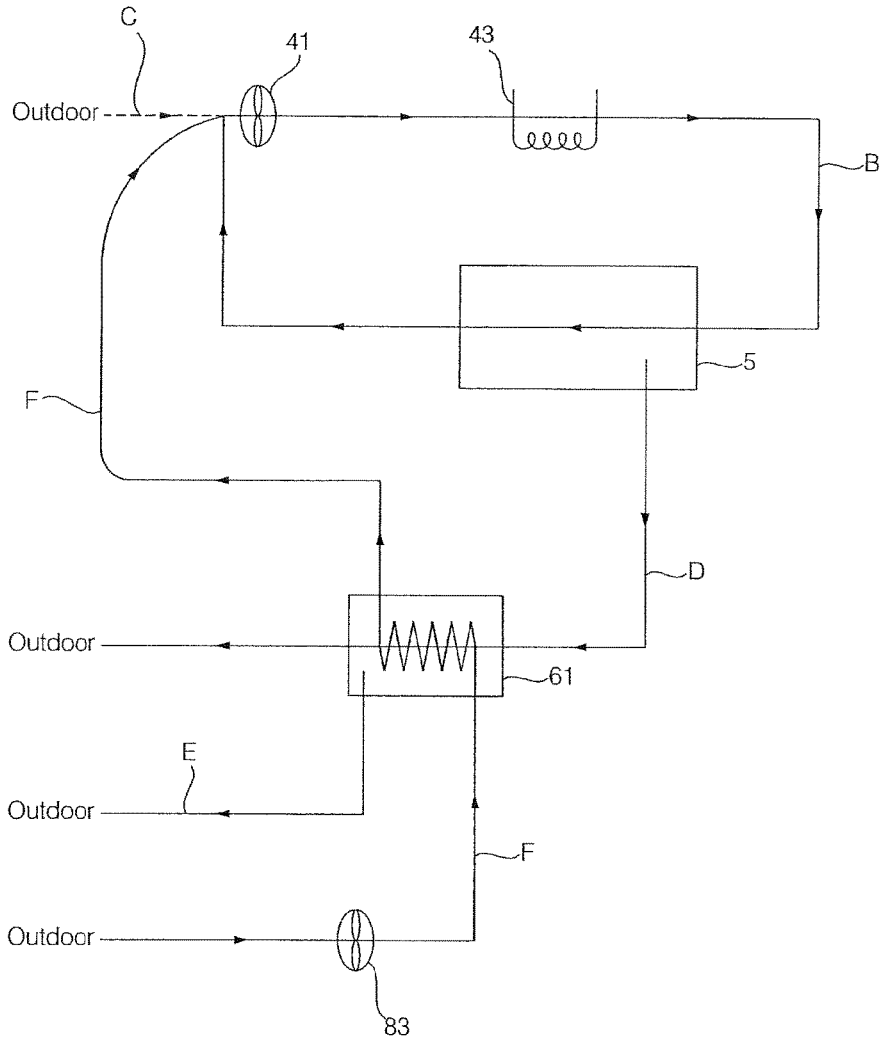
FIGS. 4 and 5 are conceptual diagrams of example flows of air and condensed water.

Hereinafter, flows of air and water according to another implementation will be described mainly in conjunction with differences from the previous implementation. FIG. 4 illustrates example flows of air and condensed water.

Descriptions of directions of arrows B, C, D, and E may be the same as those of FIG. 2.

The direction of an arrow F is a flow direction of cold air. The cold air duct 80 may be implemented with a separate pipe or duct. The washing machine includes a cooling fan 83 for moving air in the cold air duct 80. During operation of the cooling fan 83, air present outside the outer tub 5 or cabinet 1 is guided to the gaps 62 of the heat-exchanging tubes 61 along the first section 81 of the cold air duct 80. The air moving through the gaps 62 exchanges heat with air moving through the heat-exchanging tubes 61.

The cold air duct 80 guides at least a portion of air at downstream sides of the gaps 62 to be introduced into the circulation duct 40. That is, air at the downstream sides of the gaps 62 having increased in temperature is introduced into the circulation duct 40 after moving along the second section 82 of the cold air duct 80. The cold air duct 80 (the second section 82 thereof) may be directly connected to the circulation duct 40 or may be connected to the air suction duct 45. In addition, a portion of air moving along the second section 82 of the cold air duct 80 may be exhausted to the outside, and only the remaining portion of the air may be introduced into the circulation duct 40.

Air at the downstream sides of the gaps 62 having exchanged heat has a higher temperature than that of air at upstream sides of the gaps 62. As air heated while flowing through the gaps 62 is introduced into the circulation duct 40, it may be possible to reduce heating load of the heater 43.

Furthermore, the heater 43 is disposed downstream of a point where air present in the cold air duct 80 is introduced into the circulation duct 40. When the cold air duct 80 is directly connected, at a downstream end thereof, to the circulation duct 40, the heater 43 is disposed downstream of a connection point between the cold air duct 80 and the circulation duct 40. In some implementations, when the cold air duct 80 is directly connected, at the downstream end thereof, to the air suction duct 45, the heater 43 is disposed downstream of a connection point between the air suction duct 45 and the circulation duct 40.

Figure 5:
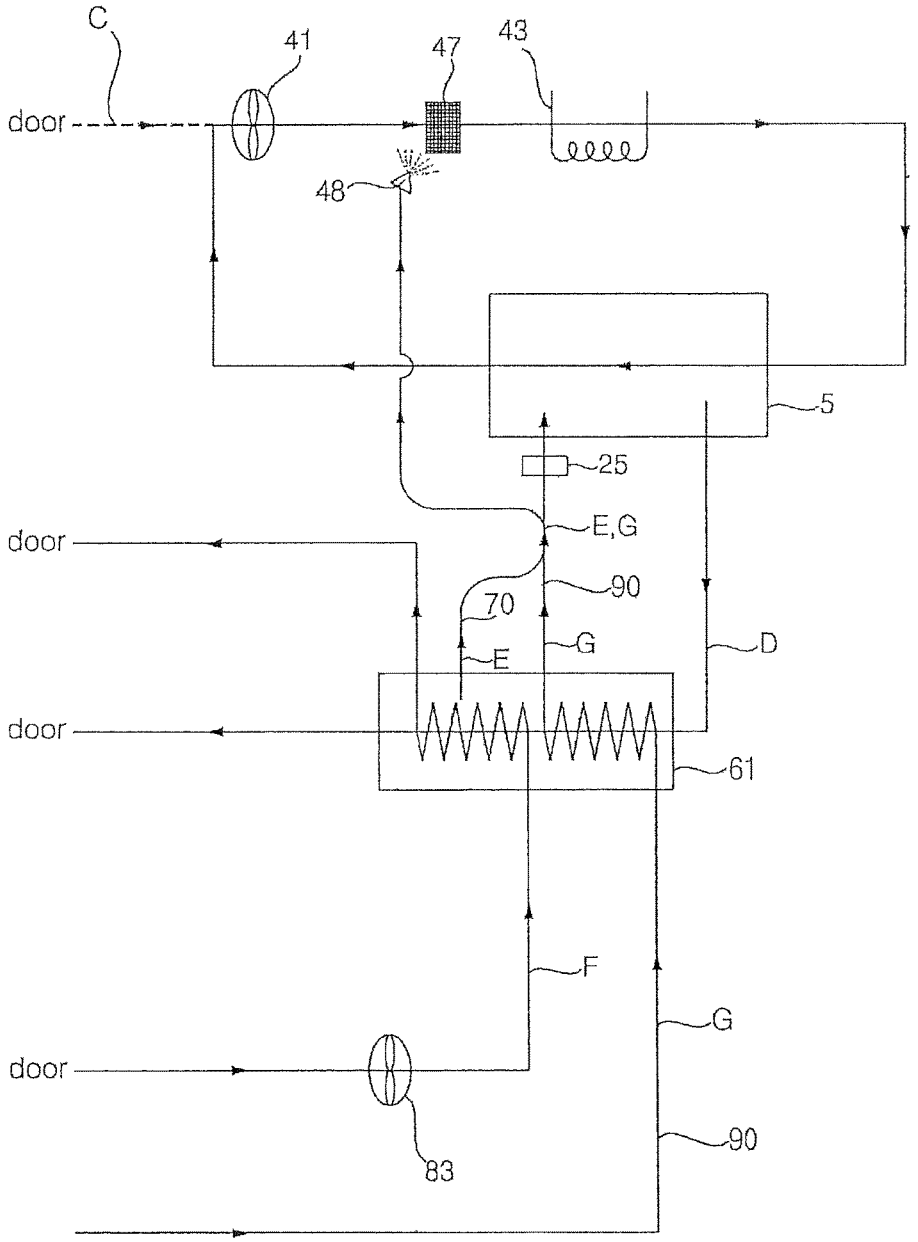

Hereinafter, flows of air and water according to another implementation will be described mainly in conjunction with differences from the implementation of FIG. 2. FIG. 5 illustrates example flows of air and condensed water.

Descriptions of directions of arrows B, C, D, and F may be the same as those of the implementation of FIG. 2.

The direction of an arrow E is a flow direction of condensed water. Condensed water generated in the heat-exchanging tubes 61 flows downwards along the inner surfaces of the heat-exchanging tubes 61 and, as such, is collected at the first connector 65 or second connector 66. The collected condensed water may be guided to the detergent supplier 25 or filter washing nozzle 48 along the condensed water pipe 70. The condensed water may be guided to the detergent supplier 25 along the condensed water pipe 70. In some implementations, the condensed water may be guided to the filter washing nozzle 48 along the condensed water pipe 70. In some implementations, the condensed water pipe 70 may guide at least a portion of the condensed water to be introduced into the detergent supplier 25 or filter washing nozzle 48.

The direction of an arrow G is a flow direction of cooling water. In some implementations, for example, FIG. 5, the washing machine includes a cooling water pipe 90 for guiding water (cooling water) to pass through the gaps 62. The cooling water pipe 90 may be implemented by a separate pipe or the like. Water (cooling water) guided to the gaps 62 exchanges heat with air present in the plurality of heat-exchanging tubes 61. The water (cooling water) having exchanged heat may be drained outwards. In some implementations, for example, FIG. 5, the water may be guided to the detergent supplier 25 or filter washing nozzle 48. In detail, the water may be guided to the detergent supplier 25 along the cooling water pipe 90. In some implementations, the water may be guided to the filter washing nozzle 48 along the cooling water pipe 90. In some implementations, at least a portion of the water may be guided to be introduced into the detergent supplier 25 or filter washing nozzle 48 at downstream sides of the gaps 62.

In some implementations, for example, FIG. 5, the condensed water pipe 70 is connected to the cooling water pipe 90, to guide condensed water to the downstream sides of the gaps 62. That is, the connection point of the cooling water pipe 90 to the condensed water pipe 70 is disposed downstream of the gaps 62. In some implementations, condensed water generated in the plurality of heat-exchanging tubes 61 is introduced into the cooling water pipe 90 along the condensed water pipe 70, and is moved to a downstream end of the cooling water pipe 90 along the cooling water pipe 90.

Water introduced into the cooling water pipe 90 may be water guided along the water supply line 23 after being supplied from the water supply source may be condensed water generated in the heat-exchanging small diameter tubes 61, or may be wash water used in the outer tub 5.

In some implementations, condensed water may be introduced into the cooling water pipe 90, to exchange heat with exhaust air. To this end, the condensed water pipe 70 is connected to the cooling water pipe 90, to guide condensed water to upstream sides of the gaps 62. The connection point of the condensed water pipe 70 to the cooling water pipe 90 is positioned at the upstream sides of the gaps 62. In some implementations, condensed water generated in the plurality of heat-exchanging tubes 61 is introduced into the cooling water pipe 90 along the condensed water pipe 70, and is moved to the downstream end of the cooling water pipe 90 after flowing through the gaps 62 along the cooling water pipe 90.

In some implementations, condensed water is moved to the downstream end of the cooling water pipe 90 along the cooling water pipe 90 after being mixed with externally supplied water introduced into the cooling water pipe 90 and, as such, may be guided to the detergent supplier 25 or filter washing nozzle 48. The water mixture of the condensed water and externally supplied water may be guided to the detergent supplier 25. In some implementations, the water mixture may be guided to the filter washing nozzle 48. In some implementations, the cooling water pipe 90 may guide at least a portion of the water mixture to be introduced into the detergent supplier 25 and filter washing nozzle 48 at a position downstream of the gaps 62.

Figure 6:
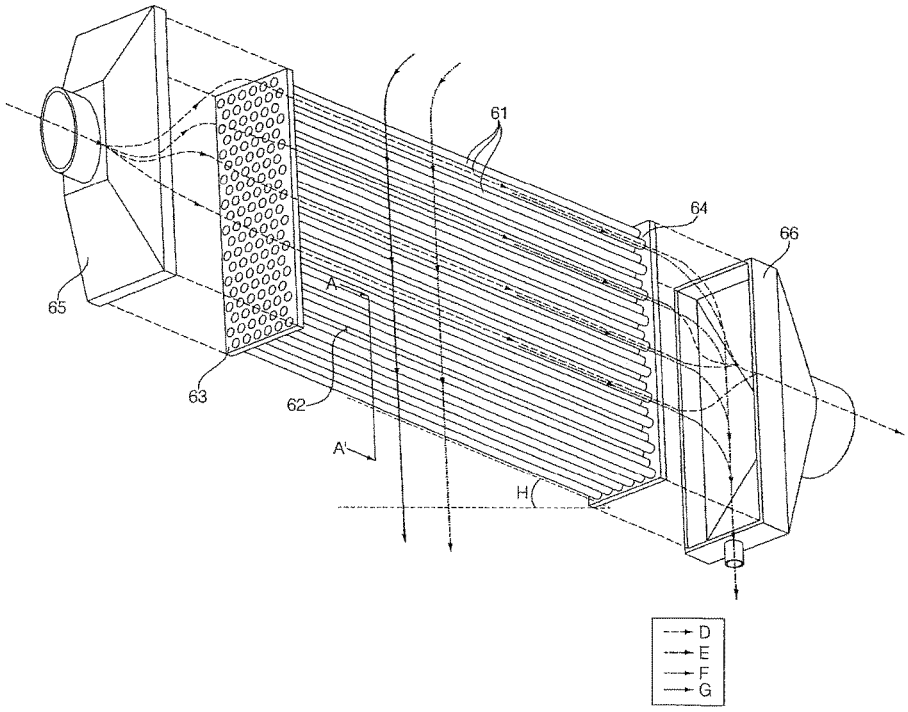
FIGS. 6 and 7 are perspective views of example heat-exchanging tubes.
Figure 7:
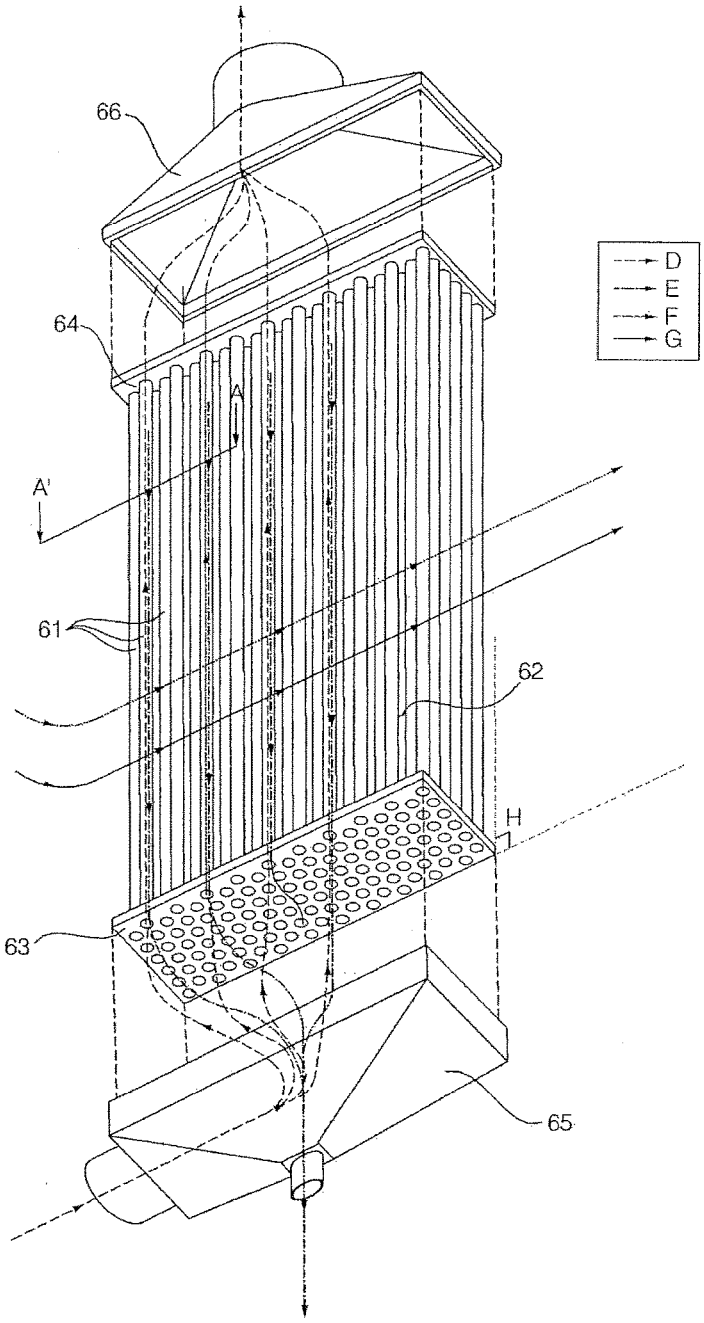
Figure 8:
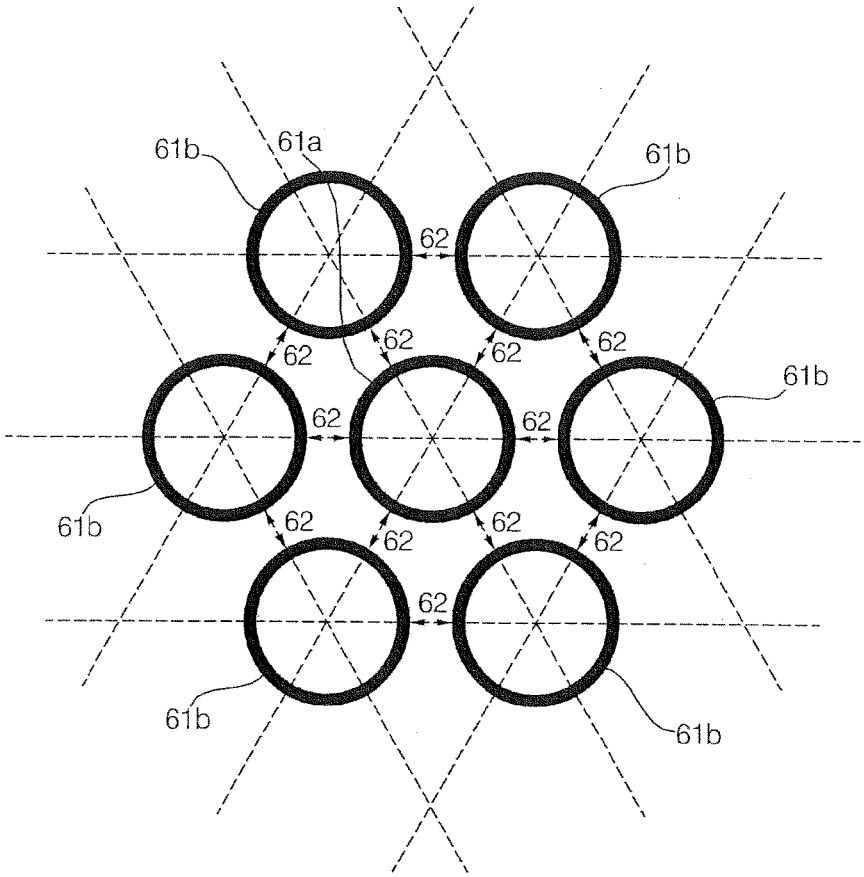
FIG. 8 is a cross-sectional view taken along line A-A' in FIG. 6 or 7 of example heat-exchanging tubes.

Hereinafter, the configuration and arrangement of the plurality of heat-exchanging tubes 61 and flows of air and water will be described in detail with reference to FIGS. 6 to 8. FIGS. 6-8 illustrate example heat-exchanging tubes 61. The heat-exchanging tubes 61 are coupled together at upstream ends thereof while being coupled together at downstream ends thereof. The upstream ends mean portions of the heat-exchanging tubes 61, through which exhaust air is introduced into the heat-exchanging tubes 61. The downstream ends mean portions of the heat-exchanging tubes 61, through which exhaust air is discharged outwards from the heat-exchanging tubes 61. An upstream end retainer 63 is disposed at the upstream ends. A downstream end retainer 64 is disposed at the downstream ends. The upstream end retainer 63 and downstream end retainer 64 retain the heat-exchanging tubes 61 to maintain the gaps 62. In addition, the upstream end retainer 63 is connected to the first connector 65, whereas the downstream end retainer 64 is connected to the second connector 66. The upstream end retainer 63 and downstream end retainer 64 may be injection-molded together with the heat-exchanging tubes 61, to form an integrated structure. In some implementations, the upstream end retainer 63 and downstream end retainer 64 may be assembled to the heat-exchanging tubes 61 after being prepared as separate elements.

The heat-exchanging tubes 61 may be made of a synthetic resin material. When the heat-exchanging tubes 61 is made of a synthetic resin material, it may be possible to achieve convenient manufacture and cost reduction, so long as there is no deformation of the heat-exchanging tubes 61 caused by the temperature of exhaust air.

Each heat-exchanging tube 61 may have a diameter of about 5 to 7 mm. When the diameter of each heat-exchanging tube 61 is smaller, there may be increased advantages, so long as condensed water can smoothly flow in the heat-exchanging tube 61 without plugging the heat-exchanging tube 61 due to viscosity thereof. When each heat-exchanging tube 61 has a diameter of about 5 to 7 mm, it may be possible to achieve smooth flow of condensed water in the heat-exchanging tube 61 while achieving efficient heat exchange between the heat-exchanging medium (cold air or cooling water) and the exhaust air. The dimension of each gap 62 may be smaller than the diameter of each heat-exchanging tube 61.

FIG. 8 illustrates an arrangement of the plurality of heat-exchanging tubes 61 in which six tubes 61*b* spaced apart from each other by a predetermined distance to form the gaps 62 are arranged around another tube, namely, a tube 61*a*, while being spaced apart from the tube 61*a* by the same distance as the predetermined distance, to form the gaps 62. In accordance with this arrangement of the heat-exchanging tubes 61, it may be possible to achieve modular design of the heat-exchanging tubes 61. In addition, it may be possible to achieve expansion of the above-described arrangement in 6 directions around the tube 61*a* when viewed in cross-section. Adjacent ones of the 6 directions form an angle of 60° therebetween. In some implementations, the plurality of heat-exchanging tubes 61 may be designed and manufactured to be mounted to the washing machine.

The upstream end retainer 63 and first connector 65 may have structures to be assembled to each other in a fitting manner. Similarly, the downstream end retainer 64 and second connector 66 may have structures to be assembled to each other in a fitting manner. The first connector 65 distributes exhaust air to the heat-exchanging tubes 61. The second connector 66 collects air discharged from the heat-exchanging tubes 61 in the exhaust duct 50 (the second section 52 of the exhaust duct 50).

The heat-exchanging tubes 61 may have a slope to allow condensed water generated in the tubes 61 to flow downwards along the inner surfaces of the tubes 61 by gravity. In some implementations, for example, FIG. 6, the heat-exchanging tubes 61 are arranged to have a slope in a downstream direction of the exhaust duct 50. In some implementations, for example, FIG. 7, the heat-exchanging tubes 61 are arranged to have a slope in an upstream direction of the exhaust duct 50.

As illustrated in FIGS. 6 and 7, exhaust air flows in the direction of the arrow D while sequentially passing through the first connector 65, heat-exchanging tubes 61, and second connector 66. Cold air flows in the direction of the arrow F while passing around the gaps 62. Cooling water flows in the direction of the arrow G while passing around the gaps 62. The flow direction of the cold air or cooling water may be reverse to that of FIGS. 6 and 7. Air passing through the heat-exchanging tubes 61 may generate condensed water when the temperature thereof is reduced to a saturation temperature in accordance with heat exchange thereof with the cold air or cooling water.

In some implementations, for example, FIG. 6, the heat-exchanging tubes 61 have a slope in a downstream direction of exhaust air. That is, the heat-exchanging tubes 61 have a slope angle H with respect to a horizontal plane. Air present in the heat-exchanging tubes 61 flows in a downward direction D in accordance with the slope of the tubes 61. Condensed water generated in the heat-exchanging tubes 61 flows in a downward direction E in accordance with the slope of the tubes 61. The condensed water pipe 70 is connected to the downstream sides of the heat-exchanging tubes 61. In detail, the condensed water pipe 70 may be connected to the second connector 66. In this case, condensed water is introduced into the condensed water pipe 70 after flowing to the second connector 66 through the downstream end retainer 64.

In some implementations, for example, FIG. 7, the heat-exchanging tubes 61 have a slope in an upstream direction of exhaust air. That is, the heat-exchanging tubes 61 have the slope angle H with respect to a horizontal plane. Air present in the heat-exchanging tubes 61 flows in an upward direction D in accordance with the slope of the tubes 61. Condensed water generated in the heat-exchanging tubes 61 flows in a downward direction E in accordance with the slope of the tubes 61. The condensed water pipe 70 is connected to the upstream sides of the heat-exchanging tubes 61. In detail, the condensed water pipe 70 may be connected to the first connector 65. In this case, condensed water is introduced into the condensed water pipe 70 after flowing to the first connector 65 through the upstream end retainer 63.

In some implementations, for example, FIGS. 6 and 7, the slope angle H is defined to include an angle of up to 90°. When the slope angle H is 90°, condensed water flows downwards along the inner surfaces of the heat-exchanging tubes 61 in a vertical downward direction ("E" in FIG. 7).

What is claimed is:

1. A laundry treatment apparatus comprising:

a cabinet;

an outer tub that is located in the cabinet;

a circulation duct that is configured to guide air circulating through the outer tub;

an exhaust duct that is configured to guide air exhausted from the outer tub;

an air suction duct that is configured to guide air from outside the laundry treatment apparatus into the outer tub;

a fan that is configured to circulate air through the outer tub; a heater that is located in the circulation duct and that is configured to heat air entering the outer tub;

a plurality of heat-exchanging tubes that are located at the exhaust duct and that is configured to allow air to pass through gaps that are defined by the plurality of heat-exchanging tubes that are spaced apart from each other a predetermined distance; and a condensed water pipe that is configured to guide water that condenses on the plurality of heat-exchanging tubes.

2. The laundry treatment apparatus according to claim 1, wherein:

the air suction duct is configured to guide air into the circulation duct; and the heater is located between (i) an intersection of the air suction duct and the circulation duct and (ii) the outer tub.

3. The laundry treatment apparatus according to claim 1, further comprising:

a cold air duct that is configured to guide air from outside the laundry treatment apparatus through the gaps in the plurality of heat-exchanging tubes; and a cooling fan to move air in the cold air duct.

4. The laundry treatment apparatus according to claim 3, wherein the cold air duct is configured to guide air into the circulation duct and into a downstream side of the gaps of the plurality of heat-exchanging tubes.

5. The laundry treatment apparatus according to claim 4, wherein the heater is located between (i) an intersection of the cold air duct and the circulation duct and (ii) the outer tub.

6. The laundry treatment apparatus according to claim 1, further comprising:

a cooling water pipe that is configured to guide water through the gaps in the plurality of heat-exchanging tubes.

7. The laundry treatment apparatus according to claim 6, wherein the condensed water pipe is connected to the cooling water pipe and is configured to guide condensed water to a downstream side of the gaps in the plurality of heat-exchanging tubes.

8. The laundry treatment apparatus according to claim 6, wherein the condensed water pipe is connected to the cooling water pipe and is configured to guide condensed water to an upstream side of the gaps in the plurality of heat-exchanging tubes.

9. The laundry treatment apparatus according to claim 6, further comprising:

a detergent supplier that is configured to supply detergent and water to the outer tub, wherein the cooling water pipe is configured to guide water to the detergent supplier from a downstream side of the gaps in the plurality of heat-exchanging tubes.

10. The laundry treatment apparatus according to claim 6, further comprising:

a filter that is configured to filter foreign matter from air; and a filter washing nozzle that is configured remove filtered foreign matter from the filter by providing water to the filter, wherein the cooling water pipe is configured to guide water from a downstream side of the gaps in the plurality of heat-exchanging tubes to the filter washing nozzle.

11. The laundry treatment apparatus according to claim 1, further comprising:

a detergent supplier that is configured to supply detergent and water to the outer tub, wherein the condensed water pipe is configured to guide condensed water to the detergent supplier.

12. The laundry treatment apparatus according to claim 1, further comprising:

a filter that is configured to filter foreign matter from air; and a filter washing nozzle that is configured remove filtered foreign matter from the filter by providing water to the filter, wherein the condensed water pipe is configured to guide condensed water to the filter washing nozzle.

13. The laundry treatment apparatus according to claim 1, wherein upstream ends of the plurality of heat-exchanging tubes are coupled together and downstream ends of the plurality of heat-exchanging tubes are coupled together.

14. The laundry treatment apparatus according to claim 1, wherein:

the plurality of heat-exchanging tubes each define a center point and center points of six heat-exchanging tubes define corners of a regular hexagon, a center point of a seventh heat-exchanging tube is located at a center of the regular hexagon, and each distance that separates adjacent heat-exchanging tubes of the six and seventh heat-exchanging tubes is a same predetermined distance.

15. The laundry treatment apparatus according to claim 1, wherein downstream ends of the plurality of heat-exchanging tubes are sloped towards the exhaust duct.

16. The laundry treatment apparatus according to claim 15, wherein the condensed water pipe is connected to the downstream ends of the plurality of heat-exchanging tubes.

17. The laundry treatment apparatus according to claim 1, wherein upstream ends of the plurality of heat-exchanging tubes are sloped towards the exhaust duct.

18. The laundry treatment apparatus according to claim 17, wherein the condensed water pipe is connected to the upstream ends of the plurality of heat-exchanging tubes.

19. The laundry treatment apparatus according to claim 15, wherein the downstream ends of the plurality of heat-exchanging tubes are sloped towards the exhaust duct 90 degrees.

20. The laundry treatment apparatus according to claim 17, wherein the upstream ends of the plurality of heat-exchanging tubes are sloped towards the exhaust duct 90 degrees.

* * * * *